US008752537B2

(12) United States Patent
Kim

(10) Patent No.: US 8,752,537 B2
(45) Date of Patent: Jun. 17, 2014

(54) SAWING APPARATUS OF SINGLE CRYSTAL INGOT

(75) Inventor: Yang-Suh Kim, Gyeongbuk (KR)

(73) Assignee: LG Siltron Inc., Gyeongsangbuk-do (KR)

( * ) Notice: Subject to any disclaimer, the term of this patent is extended or adjusted under 35 U.S.C. 154(b) by 243 days.

(21) Appl. No.: 13/249,206

(22) Filed: Sep. 29, 2011

(65) Prior Publication Data

US 2013/0081606 A1 Apr. 4, 2013

(30) Foreign Application Priority Data

Sep. 29, 2010 (KR) ..... 10-2010-0094437
Feb. 7, 2011 (KR) ..... 10-2011-0010607

(51) Int. Cl.
*B28D 5/04* (2006.01)

(52) U.S. Cl.
USPC ..... 125/21; 125/16.02; 125/38

(58) Field of Classification Search
CPC ..... B28D 5/04; B28D 5/042; B28D 5/045; B28D 7/02
USPC ..... 125/12, 16.02, 38; 451/60, 446, 451/451–455; 83/651.1
See application file for complete search history.

(56) References Cited

U.S. PATENT DOCUMENTS 371,313 A * 10/1887 Green ..... 125/19
2,469,531 A * 5/1949 Toth et al. ..... 82/152
2,483,882 A * 10/1949 Cooper ..... 451/178
3,400,494 A * 9/1968 Seitz ..... 451/311
5,097,637 A * 3/1992 Shepherd ..... 51/295
5,692,947 A * 12/1997 Talieh et al. ..... 451/41
5,927,131 A * 7/1999 Kiuchi et al. ..... 72/274
6,006,737 A * 12/1999 Hayashi et al. ..... 125/16.02
6,390,896 B1 * 5/2002 Huber et al. ..... 451/59
6,832,606 B2 * 12/2004 Yamada et al. ..... 125/13.01
7,306,508 B2 * 12/2007 Kawasaki et al. ..... 451/7
7,793,647 B2 * 9/2010 Skovgaard-Soerensen 125/16.02
8,434,468 B2 5/2013 Kitagawa
2009/0305612 A1 * 12/2009 Miyazaki et al. ..... 451/11
2010/0206285 A1 * 8/2010 Kitagawa ..... 125/16.02
2012/0085333 A1 * 4/2012 Kwon et al. ..... 125/21

FOREIGN PATENT DOCUMENTS

JP 2002-307283 10/2002
JP 2003-001624 1/2003
JP 2004-074401 3/2004
JP 2005-153031 6/2005
JP 2006-305685 11/2006
JP 2009-113173 5/2009

OTHER PUBLICATIONS

PCT International Search Report for Application No. PCT/KR2011/002510 mailed Jan. 12, 2012, 10 pages.
Korean Application No. 10-2010-0094437, Office Action dated Dec. 26, 2012.
Notice of Allowance for KR 10-2010-0094437 dated Jun. 11, 2013, 11pg (best available copy provided, no English translation available).

* cited by examiner

*Primary Examiner* — George Nguyen
(74) *Attorney, Agent, or Firm* — Lewis Roca Rothgerber LLP

(57) ABSTRACT

Provided is a single crystal ingot sawing apparatus. The single crystal ingot sawing apparatus includes a wire saw configured to slice an ingot, a roller for configured to drive the wire saw, and a slurry bath for configured to receive slurry supplied onto the wire saw.

7 Claims, 5 Drawing Sheets

SAWING APPARATUS OF SINGLE CRYSTAL INGOT

CROSS-REFERENCE TO RELATED APPLICATIONS

The present application claims the priority benefit of Korean patent application number 10-2011-0010607 filed Feb. 7, 2011 and Korean patent application number 10-2010-0094437 filed Sep. 29, 2010, the disclosures of which are incorporated herein by reference.

BACKGROUND OF THE INVENTION

1. Field of the Invention

The present invention relates to sawing apparatus of a single crystal ingot.

2. Background of the Related Art

Wafers such as silicon are manufactured by slicing a single silicon ingot into slices having a thin thickness. For example, a single crystal ingot is sliced in a wafer form using a predetermined sawing apparatus such as a wire saw while the ingot mounted on a table is moved and slurry is supplied.

However, a distance between a wire and the table is gradually reduced toward a rear end of the ingot to be sliced. As a result, the slurry which is not used during the slicing of the ingot, is supplied into the ingot to be sliced to cause the excessive supply of the slurry. Due to the excessive supply of the slurry, the ingot is over-cooled causing non-uniform shape of a sliced surface of the wafer, thereby deteriorating quality of the wafer.

The slurry (abrasive+oil) also acts as slicing and lubricating agents in the wire saw thereby affecting the quality of the sliced wafer. Although the slurry smeared on a wire acts as the slicing agent for slicing the ingot, scattered slurry or slurry scattered by the wire reciprocated at a high speed may be permeated and accumulated between wafers generated by slicing the ingot to deform a shape of the wafer.

FIG. 1 is a graph illustrating a sliced wrap profile due to slurry supply failure in a related art. FIG. 2 is a nano-map illustrating an example of nano-waviness due to non-uniformly sliced wrap profile.

According to the related art, the slurry scattered when an end (a rear end to be sliced) of the silicon ingot is sliced within the wire saw may have a bad influence on the wafer or straightness of the wire to deform a shape of the end of the wafer. As a result, a flow amount of slurry may be generally reduced at the rear end of the ingot to be sliced. However, when the flow amount of slurry is reduced, a slurry curtain phenomenon (slurry is uniformly spread) may not occur.

Thus, as shown in FIG. 1, the slurry supply failure may occur at a specific portion of the ingot. Therefore, the sliced wrap profile of the wafer may be non-uniform. Also, due to the non-uniform shape of the sliced wrap profile of the wafer, as shown in FIG. 2, waviness pattern errors may occur in a nano-topography process after a polishing process.

SUMMARY OF THE CLAIMED INVENTION

Embodiments provide a single crystal ingot sawing apparatus in which scattered slurry or slurry permeated and accumulated between wafers generated by slicing the ingot except slurry smeared on a wire saw used for slicing an ingot is controlled to prevent a sliced shape of the wafer from being deformed in a wire saw process.

In one embodiment, a single crystal ingot sawing apparatus includes: a wire saw configured to slice an ingot; a roller for configured to drive the wire saw; and a slurry bath for configured to receive slurry supplied onto the wire saw. The slurry bath may be disposed on each of both sides of the ingot. The slurry bath may have a groove through which the wire saw passes. The groove may be defined in a side surface or an upper portion of the slurry bath. The single crystal ingot sawing apparatus may further include a guide roller guiding the wire saw inside the slurry bath. The guide roller may be immersed into the slurry received in the slurry bath. The guide roller may be provided in plurality of along a movement direction of the wire saw.

In another embodiment, a single crystal ingot sawing apparatus includes: a wire saw configured to slice an ingot; a roller for configured to drive the wire saw; and a slurry blocking cover configured to prevent slurry supplied onto the wire saw from being scattered. The slurry blocking cover may have a groove through which the wire saw passes. The groove may have a vertical width greater than a horizontal width thereof.

DETAILED DESCRIPTION

Figure 1:
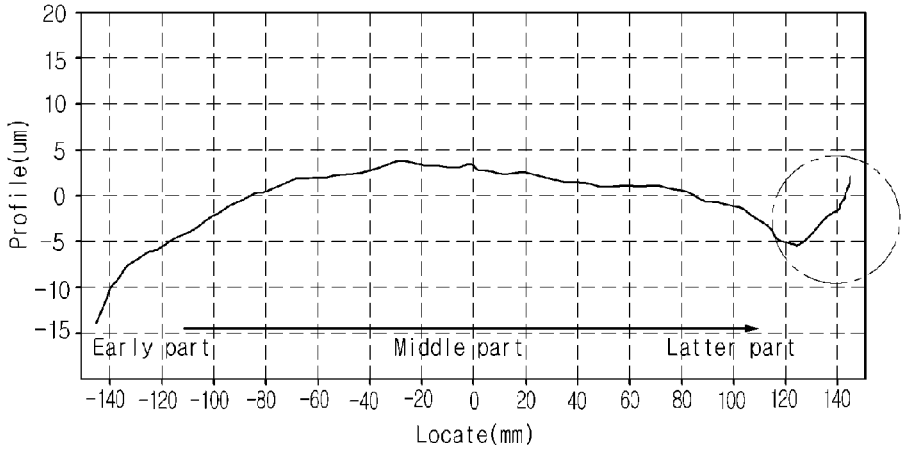
FIG. 1 is a graph illustrating a sliced wrap profile due to a slurry supply failure in a related art.
Figure 2:
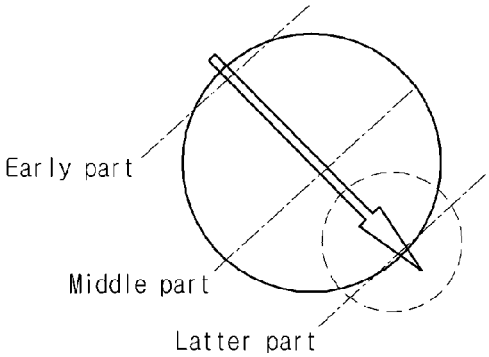
FIG. 2 is a nano-map illustrating an example of non-waviness due to non-uniformly sliced wrap profile.

The details of one or more embodiments are set forth in the accompanying drawings and the description below. Other features will be apparent from the description and drawings, and from the claims.

In the single crystal ingot sawing apparatus according to an embodiment, the deformation, which may occur by the scattered slurry and the slurry curtain phenomenon failure, of the sliced shape of the wafer at an end of the ingot to be sliced may be improved. Also, according to an embodiment, an occurrence of the waviness of the wafer disposed at a machine-side (MC-side) may be controlled to improve the nanotopography. The guide roller may be disposed within the slurry bath to stably supply the slurry onto the surface of the ware saw taken into the slurry bath.

In the descriptions of embodiments, it will be understood that when a wafer, a device, a chuck, a member, a part, a region, or a surface is referred to as being on or 'under' another wafer, device, chuck, member, part, region, or surface, it can be directly on another wafer, device, chuck, member, part, region, or surface, or intervening elements may also be present. Therefore, meaning thereof should be judged according to the spirit of the present disclosure. In the drawings, the size of each element is exaggerated for convenience in description and clarity. Also, the size of each element does not entirely reflect an actual size.

In embodiments, a single crystal ingot is manufactured as follows: a single crystal body having a rod shape is manufactured using a czochralski (CZ) method or a float zone (FZ) method. Then, an external surface of the single crystal body is processed to allow the single crystal body to have a uniform diameter. Thereafter, the single crystal body is sliced at a certain length.

Thereafter, the single crystal body ingot manufactured as described above may be sliced in a wafer form using a predetermined sawing apparatus, e.g., a wire saw while the ingot mounted on a table is moved and slurry is supplied.

Figure 3:
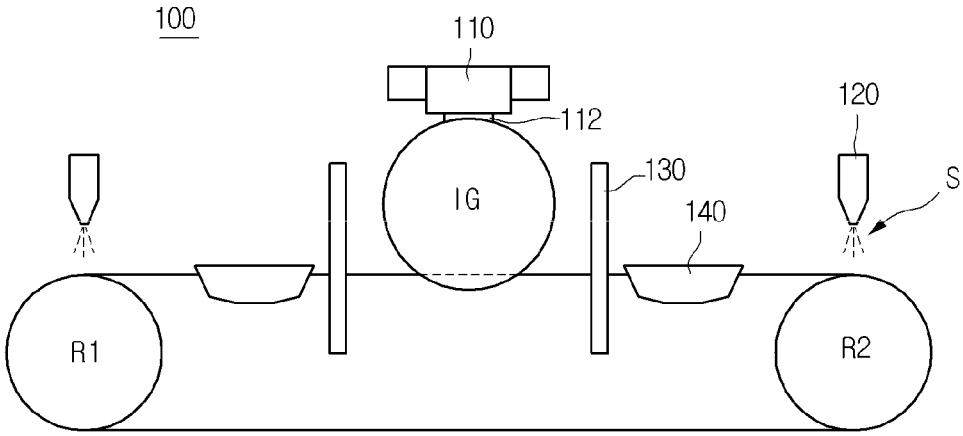
FIG. 3 is a view of a single crystal ingot sawing apparatus.

FIG. 3 is a view of a single crystal ingot sawing apparatus 100. The current embodiment provides a single crystal ingot sawing apparatus in which scattered slurry or slurry permeated and accumulated between wafers generated by slicing the ingot except slurry smeared on a wire saw used for slicing an ingot may be controlled to prevent a sliced shape of the wafer from being deformed in a wire saw process.

For this, the single crystal ingot sawing apparatus 100 according to the current embodiment may include a wire saw W for slicing an ingot IG, rollers R1 and R2 for driving the wire saw W, and a slurry blocking cover 130 for preventing slurry S supplied into the wire saw W from being scattered.

In the current embodiment, the ingot IG may be mounted on a work plate 110 using a beam 112 and then loaded on the single crystal ingot sawing apparatus 100. Thereafter, the ingot IG may be sliced.

Figure 4:
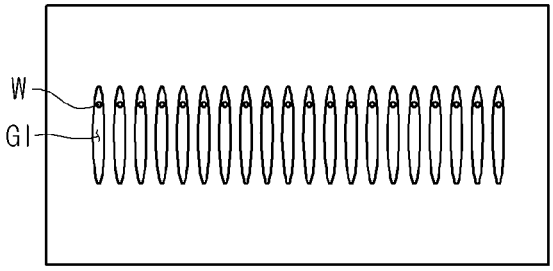
FIG. 4 is a view illustrating an example of a slurry blocking cover in the single crystal ingot sawing apparatus.
Figure 5:
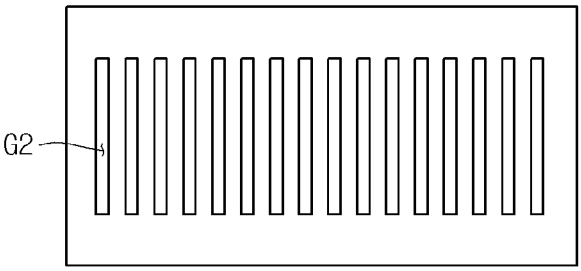
FIG. 5 is a view illustrating another example of a slurry blocking cover in the single crystal ingot sawing apparatus.

FIG. 4 is a view illustrating an example of a slurry blocking cover in the single crystal ingot sawing apparatus, and FIG. 5 is a view illustrating another example of a slurry blocking cover in the single crystal ingot sawing apparatus.

In the single crystal ingot sawing apparatus 100 according to the current embodiment, a slurry blocking cover 130 may be disposed to prevent unnecessary slurry S except slurry S smeared on the wire saw from being accessed to the ingot IG. That is, the single crystal ingot sawing apparatus 100 may control a flow of the slurry which may have a bad influence on quality depending on the sliced shape.

In the current embodiment, the slurry blocking cover 130 may have a groove through which the wire saw W passes. For example, the groove may be a groove G1 having an oval shape or a groove G2 having a square shape, but is not limited thereto. Alternatively, the groove may have a circular shape. The groove may have a vertical width greater than a horizontal width thereof. In the single crystal ingot sawing apparatus 100 according to the current embodiment, since the slurry S is injected onto the wire saw reciprocated at a high speed, a phenomenon in which the slurry S is scattered in an undesired direction may be controlled.

Also, according to the current embodiment, the slurry blocking cover 130 may include the groove through which the wire saw W passes. Here, the groove may have a gap equal to that of a pitch of a wire guide (not shown). Also, since the groove is a path through which the wire saw passes, the groove may be sufficiently considered so that it does not interfere with the wire saw. Also, the single crystal ingot sawing apparatus 100 may be designed in consideration of the wire saw hanging by a weight of the ingot IG and a downward load of the table (work plate) when the ingot is sliced. Also, in current embodiment, the slurry blocking cover 130 may be disposed both sides of the ingot due to the reciprocating motion of the wire saw, but is not limited thereto.

Figure 6:
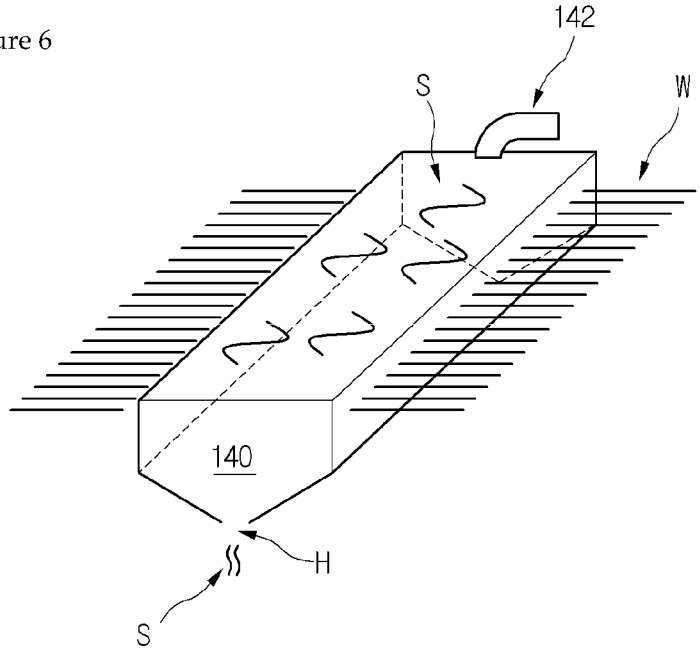
FIG. 6 is a perspective view of a slurry bath in the single crystal ingot sawing apparatus.
Figure 7:
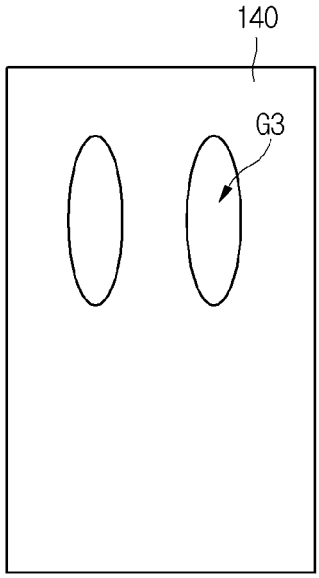
FIG. 7 is a side view of the slurry bath in the single crystal ingot sawing apparatus.
Figure 8:
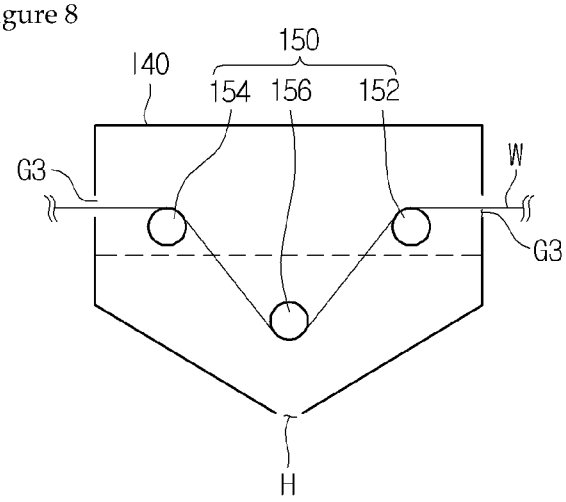
FIG. 8 is a sectional view of the slurry bath in the single crystal ingot sawing apparatus.

FIG. 6 is a perspective view of a slurry bath in the single crystal ingot sawing apparatus. FIG. 7 is a side view of the slurry bath in the single crystal ingot sawing apparatus. FIG. 8 is a sectional view of the slurry bath in the single crystal ingot sawing apparatus.

The single crystal ingot sawing apparatus according to the current embodiment may adopt a slurry bath 140 for receiving the slurry to prevent a slurry curtain phenomenon form non-uniformly occurring and prevent the slurry S injected from a slurry nozzle from being scattered. The slurry bath 140 may be disposed on both sides of the ingot, but is not limited thereto. Also, the wire saw W may pass through the slurry bath 140 to supply the slurry S to the wire saw W.

In the current embodiment, the slurry bath 140 may control the non-uniform slurry curtain phenomenon which may occur during the slicing of the ingot in an existing nozzle method to realize the uniform slurry curtain phenomenon. Also, since the wire saw W passes through the slurry bath 140 and is reciprocated, unnecessary slurry scattering may be prevented when compared to the existing nozzle method in which slurry is injected through a nozzle. That is, a flow of the slurry except the slurry S smeared on the wire saw W may be controlled.

In the current embodiment, a groove H may be defined in a lower end of the slurry bath 140 to prevent Si and Fe fine powder generated during the slicing of the ingot from being accumulated. Here, since the slurry S within the slurry bath 140 is not sufficiently smeared on the wire saw W with an amount required for slicing, but is circulated to cause a saw mark, a gap of the groove H may be adequately designed.

Also, the single crystal ingot sawing apparatus 100 according to the current embodiment may adopt a slurry nozzle above a main roller to realize a cooling effect for controlling an expansion of a wire guide, which may occur during the slicing of the ingot, but is not limited thereto. Here, the slurry may be supplied from the slurry bath 140 to the slurry nozzle 120 through a slurry pipe 142, but is not limited thereto.

Also, the single crystal ingot sawing apparatus 100 includes a slurry collection bath (not shown) in the structure as shown in FIG. 3 to collect the slurry dropping down from an upper side. Also, the collected slurry may be filtered using a predetermined filter to circulate the filtered slurry again into the slurry bath 140, but is not limited thereto.

A second groove G3 may be defined in both side surfaces of the slurry bath 140 facing each other to pass through the wire saw W. For example, the second groove G3 may have an oval shape, a square shape, or a circular shape. Here, the present disclosure is not limited to the shape of the second grove G3.

A guide roller 150 may be further provided within the above-described slurry bath 140 to immerse the wire saw W into the slurry. The guide roller 150 may include first to third guide rollers 152, 154, and 156.

The first and second guide rollers 152 and 154 are disposed on a side of the second groove G3 through which the wire saw W is taken in or out. The third guide roller 156 is disposed between the first guide roller 152 and the second guide roller 154.

The third guide roller 156 may be vertically spaced from the first and second guide rollers 152 and 154 so that it is immersed in the slurry received in the slurry bath 140.

The wire saw W taken into the slurry bath 140 is moved toward the third guide roller 156 via the first guide roller 152. Also, the slurry is uniformly supplied onto a surface of the wire saw W while the wire saw W is moved toward the third guide roller 156. As described above, the wire saw W on which the slurry is uniformly supplied may be taken out to the outside of the slurry bath 140 via the second guide roller 154.

Figure 9:
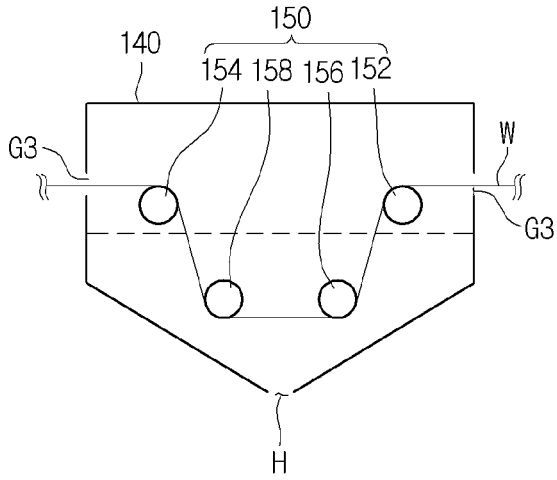
FIGS. 9 and 10 are sectional views of a slurry bath in a single crystal ingot sawing apparatus.
Figure 10:
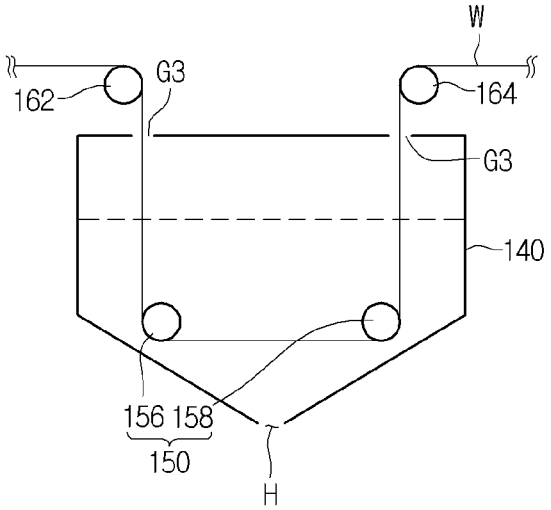

The slurry bath 140 and the guide roller 150 may be operated as follows. FIGS. 9 and 10 are sectional views of a slurry bath in a single crystal ingot sawing apparatus.

Referring to FIG. 9, a groove H is defined in a lower end of a slurry bath 140. A second groove G3 through which a wire saw W is taken in or out is disposed on both side surfaces of the slurry bath 140 facing each other. A guide roller is disposed within the slurry bath 140. The guide roller 150 moves the wire saw W to uniformly supply slurry onto the wire saw W taken in the slurry bath 140. For this, the guide roller 150 includes first to fourth guide rollers 152, 154, 156, and 158. The first and second rollers 152 and 154 are disposed on a side of the second groove G3 through which the wire saw W is taken in or out.

The third guide roller 156 and the fourth guide roller 158 are vertically spaced from the first guide roller 152 and the second guide roller 154, respectively. The third guide roller 156 and the fourth guide roller 158 are immersed in the slurry received in the slurry bath 140. Thus, the wire saw W taken in the slurry bath 140 is immersed in the slurry bath 140 while it passes through the third guide roller 156 and the fourth guide roller 158 to more uniformly supply the slurry onto a surface of the wire saw W.

As shown in FIG. 10, a groove H may be defined in a lower end of the slurry bath 140. A second groove G3 through which the wire saw W is taken in or out may be defied in an upper portion of the slurry bath 140. A guide roller 150 for immersing the wire saw W into the slurry is disposed within the slurry bath 140.

The guide roller 150 may be disposed so that it is immersed into the slurry received in the slurry bath 140. Also, the guide roller 150 may be provided in plurality. Here, the plurality of guide rollers 150 may be disposed horizontally spaced from each other. Thus, the slurry may be uniformly supplied onto a surface of the wire saw W while the wire saw W taken in the slurry bath 140 passes through the guide rollers 156 and 158. Here, auxiliary rollers 162 and 164 may be further disposed outside the surly bath 140 to guide the wire saw W to the inside of the slurry bath 140.

Figure 11:
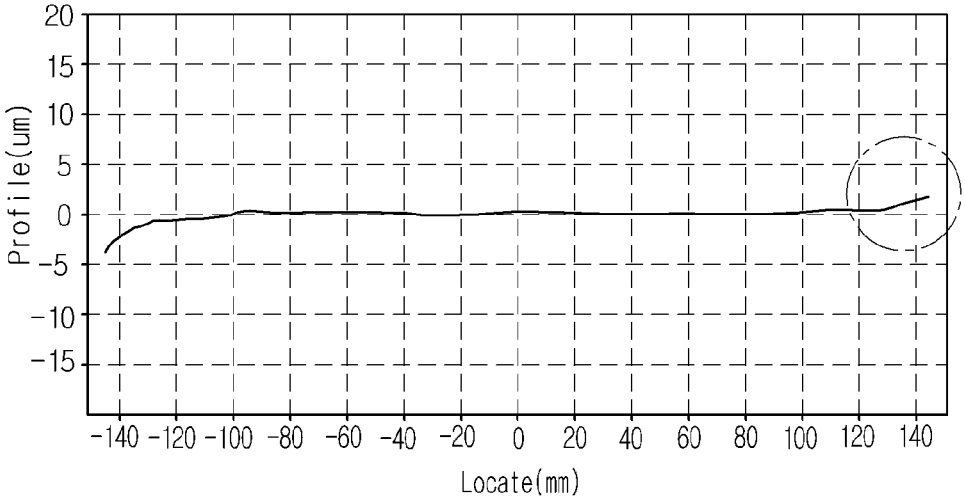
FIG. 11 is a view illustrating an example of a sliced wrap profile when the single crystal ingot sawing apparatus is applied.

FIG. 11 is a view illustrating an example of a sliced wrap profile when the single crystal ingot sawing apparatus is applied. In the single crystal ingot sawing apparatus according to the embodiment, the deformation, which may occur by the scattered slurry and the slurry curtain phenomenon failure, of the sliced shape of the wafer at an end of the ingot to be sliced may be improved as shown in FIG. 11.

Also, according to the embodiment, the warp quality of the wafer may be improved. In the embodiment, the warp represents a degree of the deformation of the wafer, and also represents a difference between a maximum vibration and a minimum vibration from a reference surface to a medium surface. According to the embodiment, a related-art warp average of about 15 or more may be improved to a warp average of less than about 15.

Also, according to the embodiment, an occurrence of the waviness of the wafer disposed at a machine-side (MC-side) may be controlled to improve the nanotopography. For example, in the embodiment, the nano represents a value which expresses a height difference of about 20 nm to about 100 nm on the surface of the wafer having a width of about 0.5 mm to about 25 mm as a figure. According to the embodiment, a related-art peak to valley (PV) of about 30 nm may be improved to a PV of about 26 nm.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A single crystal ingot sawing apparatus comprising:

a wire saw that slices an ingot;

a roller that drives the wire saw;

a slurry bath that receives slurry supplied onto the wire saw, wherein the slurry bath includes a groove for passing the wire saw through; and a guide roller, wherein the guide roller guides the wire saw inside the slurry bath.

2. The single crystal ingot sawing apparatus of claim 1, wherein the slurry bath is disposed on each of both sides of the ingot.

3. The single crystal ingot sawing apparatus of claim 1, wherein the groove is defined in a side surface of the slurry bath.

4. The single crystal ingot sawing apparatus of claim 1, wherein the guide roller is immersed in the slurry received in the slurry bath.

5. The single crystal ingot sawing apparatus of claim 4, wherein the guide roller is provided along a movement direction of the wire saw.

6. A single crystal ingot sawing apparatus comprising:

a wire saw that slices an ingot;

a roller that drives the wire saw; and a slurry blocking cover that prevents slurry supplied onto the wire saw from being scattered, wherein the slurry blocking cover includes a groove for passing the wire saw through, and wherein the groove has a vertical width greater than a horizontal width.

7. The single crystal ingot sawing apparatus of claim 1, wherein the groove is defined in an upper portion of the slurry bath.

* * * * *

UNITED STATES PATENT AND TRADEMARK OFFICE

CERTIFICATE OF CORRECTION

PATENT NO. : 8,752,537 B2
APPLICATION NO. : 13/249206
DATED : June 17, 2014
INVENTOR(S) : Yang-Sub Kim It is certified that error appears in the above-identified patent and that said Letters Patent is hereby corrected as shown below:

On the Title Page: Item (75) Inventors should read: Kim, Yang-Sub

Signed and Sealed this
Twenty-third Day of September, 2014

Michelle K. Lee

Michelle K. Lee
*Deputy Director of the United States Patent and Trademark Office*